US011823815B2

(12) United States Patent
Gargano et al.

(10) Patent No.: US 11,823,815 B2
(45) Date of Patent: Nov. 21, 2023

(54) SHIELD FOR A TERMINAL OF A HIGH-VOLTAGE ELECTRICAL DEVICE AND METHOD FOR OPERATING THE SAME

(71) Applicant: HITACHI ENERGY LTD, Zürich (CH)

(72) Inventors: Teresa Gargano, Savosa (CH); Daniele Villano, Gebenstorf (CH); Karl Frei, Baden-Dättwil (CH); Francesca Meyer, Zürich (CH)

(73) Assignee: HITACHI ENERGY LTD, Zürich (CH)

( * ) Notice: Subject to any disclaimer, the term of this patent is extended or adjusted under 35 U.S.C. 154(b) by 412 days.

(21) Appl. No.: 17/271,992

(22) PCT Filed: Aug. 28, 2019

(86) PCT No.: PCT/EP2019/072980
§ 371 (c)(1),
(2) Date: Feb. 26, 2021

(87) PCT Pub. No.: WO2020/043784
PCT Pub. Date: Mar. 5, 2020

(65) Prior Publication Data

US 2021/0319932 A1 Oct. 14, 2021

(30) Foreign Application Priority Data

Aug. 30, 2018 (EP) ..... 18191746

(51) Int. Cl.
*H01F 27/04* (2006.01)
*H01B 17/58* (2006.01)
(Continued)

(52) U.S. Cl.
CPC ..... *H01B 17/583* (2013.01); *H01F 27/04* (2013.01); *H01F 27/29* (2013.01); *H01F 27/36* (2013.01); *H01R 13/53* (2013.01); *H01R 13/74* (2013.01)

(58) Field of Classification Search
CPC .... H01B 17/583; H01B 17/00; H01B 17/005; H01B 17/12; H01B 17/56; H01F 27/04;
(Continued)

(56) References Cited

U.S. PATENT DOCUMENTS 4,222,625 A 9/1980 Reed
4,980,515 A 12/1990 Sakuma et al.
(Continued)

FOREIGN PATENT DOCUMENTS

CN 101346778 A 1/2009
CN 101641837 1/2012
(Continued)

OTHER PUBLICATIONS

International Search Report and Written Opinion of the International Searching Authority, PCT/EP2019/072980, dated Nov. 7, 2019, 14 pages.
(Continued)

*Primary Examiner* — Angel R Estrada
(74) *Attorney, Agent, or Firm* — Sage Patent Group

(57) ABSTRACT

An aspect of the present disclosure provides a shield for a terminal of a high-voltage electrical device including a first shield element having at least one axial opening and at least one lateral opening, and at least one second shield element, wherein the at least one second shield element is moveable between a first shield position and a second shield position for selectively opening and closing at least one of the at least one axial opening and the at least one first lateral opening. Further aspects provide a high-voltage electrical bushing
(Continued)

comprising a shield according to the aspect above, and a transformer including said high-voltage electrical bushing. Yet a further aspect provides a method for installing a high-voltage bushing having a shield according to the aspect above.

15 Claims, 5 Drawing Sheets

(51) Int. Cl.

| | |
|---|---|
| ***H01F 27/29*** | (2006.01) |
| ***H01F 27/36*** | (2006.01) |
| ***H01R 13/53*** | (2006.01) |
| ***H01R 13/74*** | (2006.01) |

(58) Field of Classification Search
CPC ..... H01F 27/29; H01F 27/36; H01F 27/00; H01R 13/53; H01R 13/74; H01R 13/533
USPC ..... 174/152 R, 142, 152 G, 153 G, 138 R, 174/139, 138 F, 137 R, 5 R, 14 BH, 31 R, 174/209, 155, 156; 16/2.1, 2.2
See application file for complete search history.

(56) References Cited

U.S. PATENT DOCUMENTS

| | | | | |
|---|---|---|---|---|
| 6,255,597 | B1 * | 7/2001 | Bowling | H01B 17/00 174/138 F |
| 8,426,729 | B2 * | 4/2013 | Hiller | H01B 17/66 174/138 R |
| 8,957,314 | B2 * | 2/2015 | Niles | H02G 7/00 174/172 |
| 9,960,586 | B2 * | 5/2018 | Niles | H02G 7/00 |

FOREIGN PATENT DOCUMENTS

| | | | |
|---|---|---|---|
| CN | 107677916 | A | 2/2018 |
| DE | 2554460 | A1 | 7/1976 |
| EP | 0383988 | A1 | 8/1990 |
| EP | 2028665 | A1 | 2/2009 |
| JP | H06-17218 | U | 3/1994 |
| JP | 2000-269043 | A | 9/2000 |
| KR | 1019990072388 | | 9/1999 |
| KR | 1020100047056 | | 5/2010 |
| KR | 101034878 | B1 | 5/2011 |
| KR | 1020130027050 | | 3/2013 |
| WO | WO 2008/127518 | | 10/2008 |
| WO | WO 2010/066984 | A1 | 6/2010 |

OTHER PUBLICATIONS

"RIP Transformer Oil Bushing," "HSP Catalogue With a Shield with Lateral Hole," EKTO 72.5-550 kV, HSP Hochspannungsgerate GmbH, Copyright 2015, 10 pages.
First Office Action and Search Report, Chinese Patent Application No. 201980056137.X, dated Jul. 12, 2021, 5 pages.
Notice of Grounds of Rejection, Korean Patent Application No. 10-2021-7005245, dated Jun. 4, 2021, 3 pages.
Examination Report, Indian Patent Application No. No. 202147007944, dated Jan. 19, 2022, 5 pages.

* cited by examiner

SHIELD FOR A TERMINAL OF A HIGH-VOLTAGE ELECTRICAL DEVICE AND METHOD FOR OPERATING THE SAME

CROSS REFERENCE TO RELATED APPLICATIONS

This application is a 35 U.S.C. § 371 national stage application of PCT International Application No. PCT/EP2019/072980 filed on Aug. 28, 2019, which in turns claims foreign priority to European Patent Application No. 18191746.9, filed on Aug. 30, 2018, the disclosures and content of which are incorporated by reference herein in their entirety.

FIELD OF THE DISCLOSURE

Embodiments of the present disclosure generally relate to a shield for a terminal of a high-voltage electrical device, particularly a high-voltage electrical bushing for a transformer. In particular, embodiments of the present disclosure relate to a shield for a terminal having at least one lateral opening and at least one axial opening, wherein the shield is configurable such that the openings may be selectively opened or closed. More particularly, embodiments of the present disclosure relate to a method for installing a high-voltage bushing having a shield according to the above aspects.

TECHNICAL BACKGROUND

High-voltage transformers typically include a number of electrical bushings provided therein to facilitate isolation of conductors passing through a barrier, such as a grounded transformer housing. Electrical bushings for high-voltage applications may include a dielectric body component and a means for mounting the bushing to a mounting surface. At each end of the electrical bushing, a terminal is provided for mounting at least one electrical interconnect thereto. The at least one electrical interconnect may be mounted to the terminal such that it extends either axially or laterally from the terminal. For example, a high-voltage electrical bushing may be installed to pass a conductor from a transformer on one side of a housing to a cable box on the other side of the housing. A first electrical interconnect may be axially mounted to the terminal on the transformer side, while a second electrical interconnect may be laterally mounted to the terminal on the cable box side.

Terminals of high-voltage electrical bushings can generate very strong electrical fields. Therefore, high-voltage electrical bushings require a shield surrounding the terminals. When electrical interconnects are required to be mounted either axially or laterally, the shield must provide an opening for an electrical interconnect to pass through when mounted to the terminal. However, openings in the shield compromise the electrical shielding performance of the shield. Therefore, if an opening for an electrical interconnect is not in use, it should preferably be closed to provide sufficient electrical shielding, as the localized gradient of the generated electrical field can be excessive in border regions where an opening is present. Since the mounting of electrical interconnects can be variable depending on the installation, there is a need for the shield to be adaptable to provide the required openings for the electrical interconnects while still providing electrical shielding.

One solution is to fit a specific shield with a fixed configuration depending on which openings are required. However, this option has the disadvantage of providing different shields in different configurations. Modularity of components is important to reduce the cost of manufacture and the cost of installation, hence providing different shields in different configurations is undesirable. Further, the specific shield with the required configuration must be selected and mounted during installation of the electrical bushing, which increases installation time. Furthermore, there may be a need to test or inspect the bushing and/or transformer, requiring another shield in a testing configuration different to a shield in a final configuration. A shield in a testing configuration would need to be arranged for testing, and then subsequently removed and replaced with a shield in a final configuration when testing is complete. In view thereof, it is desired to overcome at least some of the problems in the prior art.

SUMMARY OF THE DISCLOSURE

An aspect of the present disclosure provides a shield 300 for a terminal 206 of a high-voltage electrical device 200. The shield 300 comprises a first shield element 301 having at least one axial opening 304 and at least one lateral opening 305, and at least one second shield element 302, 303, wherein the at least one second shield element 302, 303 is movable between a first shield position and a second shield position for selectively opening and closing at least one of the at least one axial opening 304 and the at least one first lateral opening 305.

A further aspect of the present disclosure provides a high-voltage electrical bushing 200 comprising a shield 300 according to the aspect above.

Yet a further aspect of the present disclosure provides a transformer 100 comprising at least one high-voltage electrical bushing 200 according to the aspect above.

Yet a further aspect of the present disclosure provides a method 400 for installing a high-voltage bushing having a shield according to the aspects above. The method comprises mounting 402 the high-voltage bushing, configuring 403 the at least one axial opening and/or the at least one first lateral opening in an open state or a closed state, and terminating 404 the high-voltage bushing.

The embodiments described in the present disclosure allow for the shield to be configurable in more than one configuration. Thus, any one of the lateral or axial openings in the shield can be opened or closed depending on whether an electrical interconnect is required to pass therethrough. Further, the shield may therefore be in a single modular form which can be configured for multiple configurations of electrical interconnects. Further, the shield of the present disclosure can be mounted to the electrical bushing prior to installation and configured into the required configuration during installation, providing for a simplified and efficient installation process.

Further advantages, features, aspects and details that can be combined with embodiments described herein are evident from the dependent claims, claim combinations, the description and the drawings.

BRIEF DESCRIPTION OF THE FIGURES

The details will be described in the following with reference to the figures, wherein.

DETAILED DESCRIPTION OF THE FIGURES AND OF EMBODIMENTS

Reference will now be made in detail to the various embodiments, one or more examples of which are illustrated in each figure. Each example is provided by way of explanation and is not meant as a limitation. For example, features illustrated or described as part of one embodiment can be used on or in conjunction with any other embodiment to yield yet a further embodiment. It is intended that the present disclosure includes such modifications and variations.

Within the following description of the drawings, the same reference numbers refer to the same or to similar components. Generally, only the differences with respect to the individual embodiments are described. Unless specified otherwise, the description of a part or aspect in one embodiment can be applied to a corresponding part or aspect in another embodiment as well.

Figure 1:
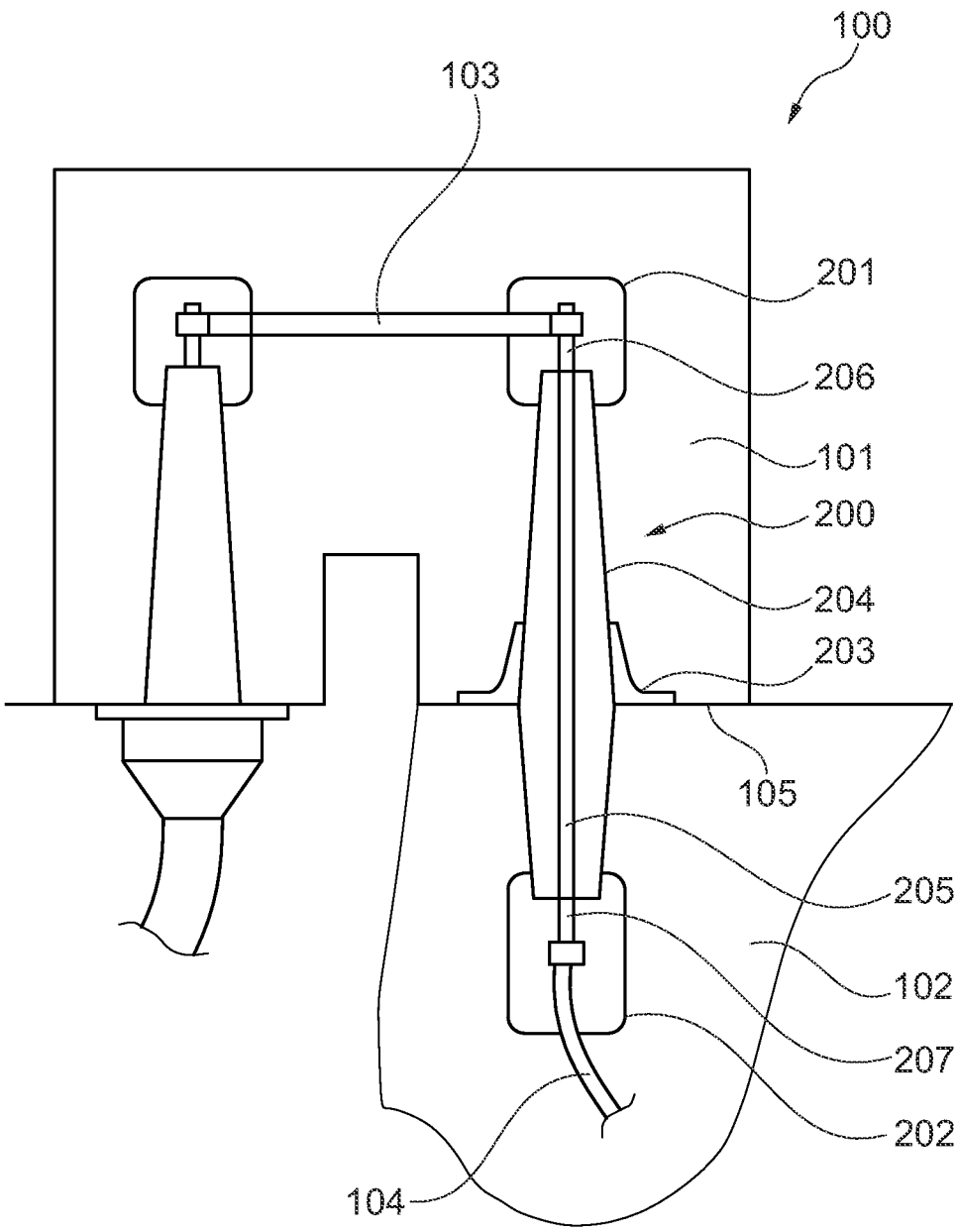
FIG. 1 is a schematic cross-sectional view of a transformer having an electrical bushing according to an embodiment of the disclosure.

FIG. 1 exemplarily shows a cross-sectional view of a transformer 100 according to an embodiment of the present disclosure. The transformer includes at least one electrical bushing 200 according to any embodiments described herein. The transformer may be, for example, a medium- or high-voltage transformer, particularly a high-voltage transformer. In the context of the present disclosure, the term "medium-voltage" may refer to a voltage of at least 1 kV and up to 52 kV. Further, the term "high-voltage" in the context of the present disclosure may refer to a voltage of at least 52 kV.

The transformer 100 may, for example, include a first region 101 and a second region 102. The first region 101 and second region 102 may be separated by a mounting surface 105. The at least one electrical bushing 200 may be mounted to mounting surface 105 such that a conductor 205 of the at least one electrical bushing 200 may pass through mounting surface 105. In other words, at least one electrical bushing 200 may be mounted in a transformer such that a conductor 205 may pass from first region 101 to second region 102. The at least one electrical bushing 200 may include a body element 204, through which conductor 205 passes. Body element 204 may be filled with an isolation medium, for example oil. Second region 102 may be filled with an isolation medium, for example oil, wherein the at least one electrical bushing 200 is partially immersed therein.

As exemplarily shown in FIG. 1, the at least one electrical bushing 200 is provided with an upper terminal 206 and a lower terminal 207. Upper and lower terminals 206, 207 are electrically connected to conductor 205. Transformer 100 may further include at least one electrical interconnect 103, 104 mounted to at least one of upper terminal 206 and lower terminal 207. The at least one electrical interconnect 103, 104 may include, for example, a conductive bar interconnect or a cable interconnect. The electrical interconnect 103, 104 may be solid or flexible.

In the example shown in FIG. 1, transformer 100 includes a lateral electrical interconnect 103 and an axial electrical interconnect 104. Lateral electrical interconnect 103 is shown to be mounted to upper terminal 206 such that lateral electrical interconnect 103 extends in a lateral direction with respect to the at least one electrical bushing 200. Axial electrical interconnect 104 is shown to be mounted to lower terminal 207 such that axial electrical interconnect 104 extends in an axial direction with respect to the at least one electrical bushing 200. The configuration of electrical interconnects 103, 104 shown in FIG. 1 is provided only as an example, and transformer 100 may have any combination of electrical bushing 200 and electrical interconnects 103, 104 attached thereto. For example, transformer 100 may include an axial electrical interconnect mounted to upper terminal 206 and a lateral electrical interconnect mounted to lower terminal 207. As a further example, transformer 100 may include two lateral electrical interconnects each mounted to upper terminal 206 and lower terminal 207, respectively.

The at least one electrical bushing 200 includes at least one shield for shielding upper terminal 206 and lower terminal 207. In this example, an upper shield 201 is provided for shielding upper terminal 206 and a lower shield 202 is provided for shielding lower terminal 207. It is clear from this example that, due to the configuration of lateral electrical interconnect 103 and axial electrical interconnect 104, the upper and lower shields 201, 202 have different configurations of openings for each electrical interconnect. In this example, upper shield 201 is provided with a lateral opening for lateral electrical interconnect 103 to pass through, while lower shield 202 is provided with an axial opening for axial electrical interconnect 104 to pass through.

Modularity of parts have advantageous properties, as modular parts allow for minimizing the number of different parts, hence reducing cost of manufacture and installation. However, simply providing the same number openings in the same positions for upper and lower shields 201, 202 may not be possible due to high electrical field gradients generated in localized regions of the openings. In the transformer of FIG. 1, for example, upper and lower shields 201, 202 may each be provided with an axial opening and a lateral opening so that the same part can be provided to shield the upper and lower terminals 206, 207, respectively. However, in this example, upper shield 201 does not require an axial opening and lower shield 202 does not require a lateral opening. Therefore, the electrical shielding performance of such a modular part would be compromised.

Figure 2:
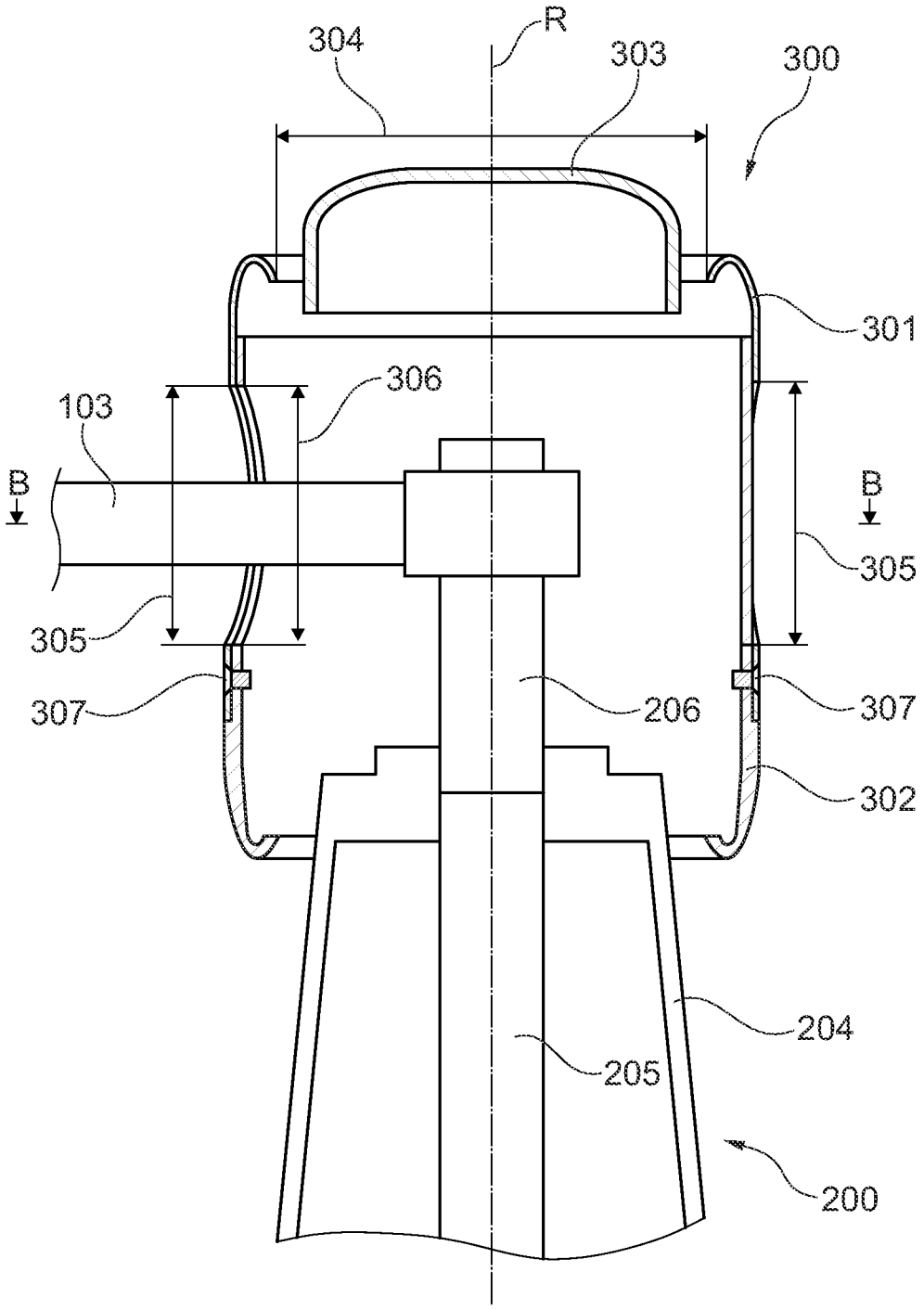
FIG. 2 is a schematic cross-sectional view of a shield for a terminal of a high-voltage device according to an embodiment of the disclosure.

Referring now to FIG. 2, an aspect of the present disclosure provides a shield 300 for a terminal 206 of a high-voltage electrical device 200. The shield 300 includes a first shield element 301 having at least one axial opening 304 and at least one first lateral opening 305, and at least one second shield element 302, 303, wherein the at least one second shield element 302, 303 is movable between a first shield position and a second shield position for selectively opening and closing at least one of the at least one axial opening 304 and the at least one first lateral opening 305.

First shield element 301 includes at least one axial opening 304. At least one axial opening 304 is provided so that an electrical interconnect 103 may be attached to terminal 206 such that electrical interconnect 103 extends in an axial direction, i.e. in the direction of longitudinal axis R, such that electrical interconnect 103 passes through at least one axial opening 304. At least one axial opening 304 may also be provided so that terminal 206 may pass therethrough, for example, on an axial end of first shield element 301 which corresponds to the side where electrical bushing 200 is provided.

First shield element 301 further includes at least one first lateral opening 305. At least one first lateral opening 305 is provided so that an electrical interconnect 103 may be attached to terminal 206 such that electrical interconnect 103 extends in a lateral direction, i.e. in a direction substantially perpendicular to longitudinal axis R, such that electrical interconnect 103 passes through at least one first lateral opening 305.

The at least axial opening 304 and at least one first lateral opening 305 may be configured such that the opening 304, 305 is in an open state or a closed state. In the context of the present disclosure, the term "open state" refers to a configuration in which an opening 304, 305 is substantially uncovered. For example, an "open state" may refer to a configuration in which 80% or more of an area of opening 304, 305 is uncovered. Similarly, a "closed state" may refer to a configuration in which 80% or more of an area of opening 304, 305 is covered. A "closed state" may therefore include configurations wherein an opening 304, 305 has some portion of an area of opening 304, 305 to be uncovered, in other words, wherein the opening 304, 305 is in a "substantially closed state". An opening 304, 305 in a closed state is essentially electrically closed, whereby the terminal 206 is electrically shielded, while still allowing for a partial opening where, for example, a fluid may flow therethrough for cooling purposes, or where manufacturing tolerances require a gap between components.

As exemplarily shown in FIG. 2, one first lateral opening 305 on the left side of FIG. 2 is shown to be in an open state, whereby over 80% of the area of the first lateral opening 305 is uncovered. Another first lateral opening 305 on the right side of FIG. 2 is shown to be in a closed state, whereby over 80% of the area of the first lateral opening 305 is covered. One axial opening 304 at the top side of FIG. 2 is shown to be in a closed state, or in this case, a substantially closed state, whereby over 80% of the area of the axial opening 304 is covered.

Shield 300 further includes at least one second shield element 302, 303. Second shield element 302, 303 may be positioned so that at least one axial opening 304 and/or the at least one first lateral opening 305 is in an open state or a closed state. As exemplarily shown in FIG. 2, second shield 302, 303 is shown in a position such that one first lateral opening 305 on the left side of FIG. 2 is in an open state, another first lateral opening 305 on the right side of FIG. 2 is in a closed state, and one axial opening 304 is an substantially closed state.

First shield element 301 and second shield element 302 are arranged such that the first and second shield elements 301, 302 substantially surround terminal 206. In the context of the present disclosure, the term "substantially surrounds" may mean that a combination of first and second shield elements 301, 302 surrounds terminal 206 around an entire circumference of first and second shield elements 301, 302, with the exception of the areas where at least one axial opening 304 and at least one lateral opening 305 are provided in an open state. First shield element 301 and second shield element 302 may be fastened to one another using fasteners 307. Fasteners 307 may be removable such that first shield element 301 and second shield element 302 may be moved from a first position to a second position.

As exemplarily shown in FIGS. 1 and 2, the high-voltage electrical device is shown to be an electrical bushing 200 having at least one terminal 206. However, the present disclosure is not limited to an electrical bushing 200. The high-voltage electrical device may be any high-voltage electrical device having a terminal which requires a shield. For example, the high-voltage electrical device may be any high-voltage electrical distribution component including, but not limited to, electrical breakers, lightning arrestors, electrical relays, bus bars, etc.

First and second shield element 301, 302, 303 may include an electrically-conductive material. For example, at least one of first and second shield element 301, 302 may be formed from the group consisting of, but not limited to, aluminium, steel, copper, and alloys thereof. First and second shield element 301, 302, 303 may be coated with a non-metallic coating, for example an epoxy layer, to reduce the effects of surface defects or protrusions. Preferably, first and second shield element 301, 302, 303 may be formed from the same material, for example, to prevent galvanic corrosion between dissimilar metals. First and second shield element 301, 302, 303 may, in some applications, be partially or completely immersed in an isolation medium, such as oil. Therefore, first and second shield element 301, 302, 303 should be formed from a material which is non-reactive to the isolation medium, and which does not degrade when immersed in the isolation medium.

According to an embodiment, which may be combined with other embodiments described herein, shield 300 may be at the same electrical potential as terminal 206. In the context of the present disclosure, the term "same electrical potential" may refer to approximately the same electrical potential. For example, terminal 206 may be at a voltage of 100 kV, while shield 300 may be at a voltage of approximately 100 kV, for example 98 kV. Preferably, shield 300 may be at a voltage within ±10% of the voltage of terminal 206. Particularly, shield 300 may be electrically connected to any one of terminal 206, conductor 205 or electrical interconnect 103. Due to the approximately same electrical potential of terminal 206 and shield 300, terminal 206 is electrically shielded such that, despite being at a high electrical potential, terminal 206 is subjected to no, or very little, electrical stress.

Figure 3A:
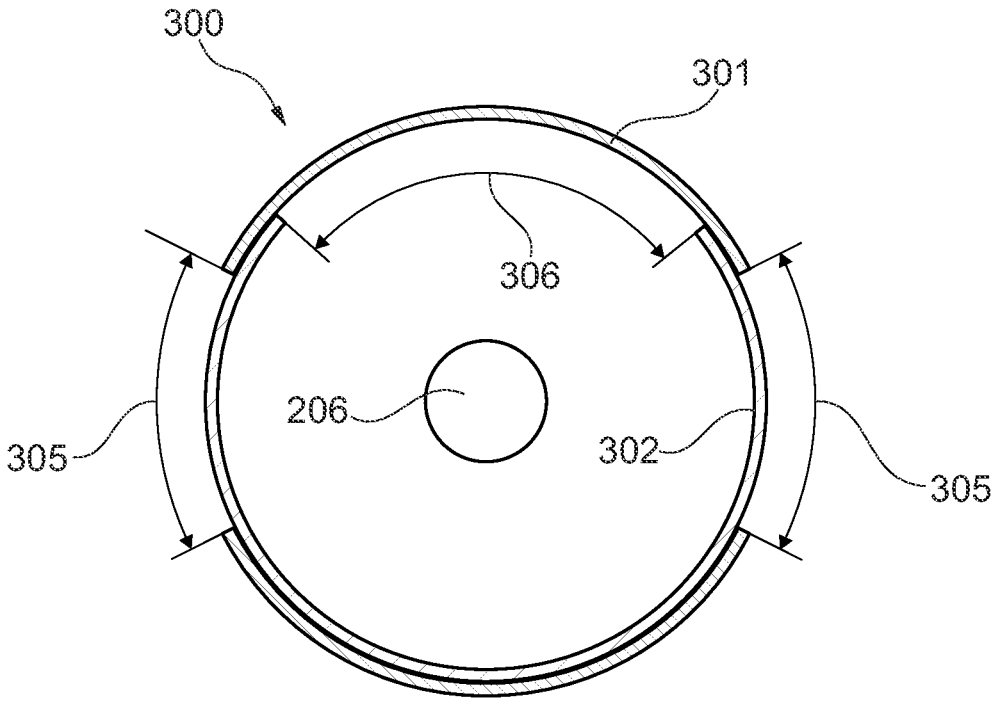
FIG. 3A-3B are schematic cross-sectional views of a shield for a terminal of a high-voltage device according to an embodiment of the disclosure.
Figure 3B:
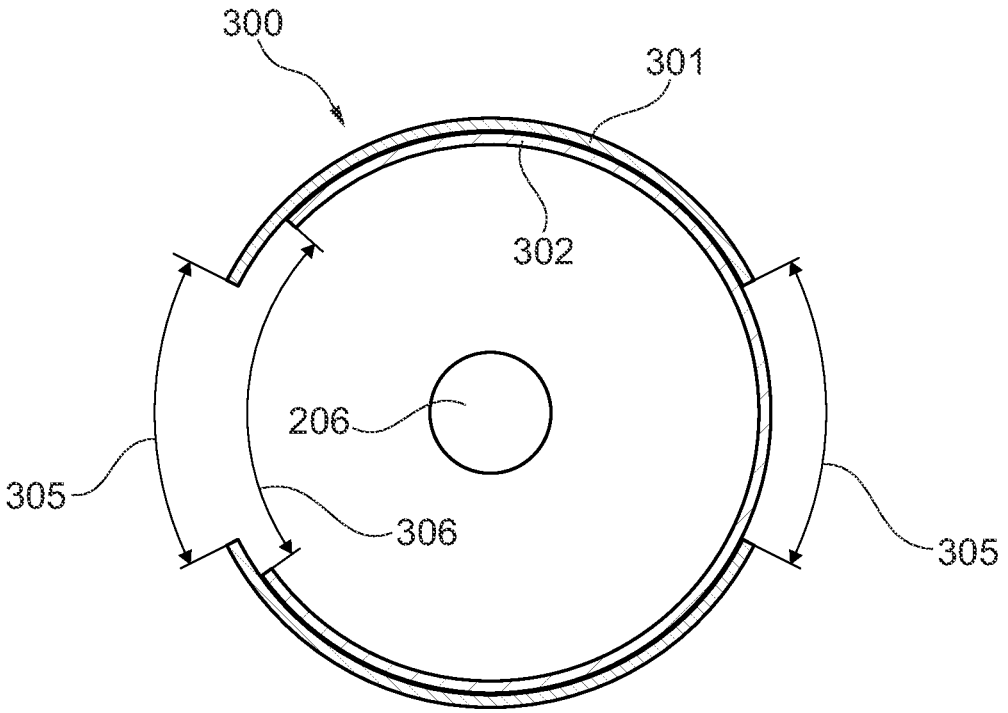

Reference will now be made to FIGS. 3A and 3B, which show cross-sectional top views of shield 300 according to embodiments described herein. Particularly, FIGS. 3A and 3B show cross-sectional views through section line B-B as shown in FIG. 2. Electrical interconnect 103 is not shown in FIGS. 3A and 3B for clarity.

According to an embodiment, which may be combined with other embodiments described herein, the at least one second shield element 302 may be a lateral shield element configured for opening or closing the at least one first lateral opening 304, and the first shield element 301 and the lateral shield element 302 are arranged concentrically to one another. First shield element 301 and lateral shield element 302 may be rotationally symmetrical about a common axis, for example, longitudinal axis R. Particularly, first shield element 301 and lateral shield element 302 may have a cylindrical shape. Alternatively, first shield element 301 and lateral shield element 302 may have a spherical shape, or a partially spherical shape.

As exemplarily shown in FIGS. 2, 3A and 3B, first shield element 301 may be arranged such that first shield element 301 is an outer shield while second shield element 302 may be arranged such that second shield 302 element is an inner shield. However, the present disclosure is not limited to this arrangement. For example, first shield 301 element and second shield element 302 may be arranged such that first shield 301 is an inner shield while second shield 302 is an outer shield.

The movement between a first shield position and a second shield position may be achieved by relative rotation between first shield element 301 and lateral shield element 302. Since first shield element 301 and lateral shield element 302 may be arranged concentrically to each other, it follows that first shield element 301 and lateral shield element 302 may be rotated within each other from a first shield position to a second shield position. In the examples shown in FIGS. 3A and 3B, first shield element 301 is maintained in a stationary position while lateral shield element 302 is rotated about longitudinal axis R. However, the present disclosure is not limited to this arrangement. For example, lateral shield element 302 may be maintained in a stationary position while first shield element 301 is rotated about longitudinal axis R.

According to an embodiment, which may be combined with other embodiments described herein, lateral shield element 302 may further include at least one second lateral opening 306, wherein the at least one first lateral opening 305 is in an open state when the at least one first lateral opening 305 is aligned with the at least one second lateral opening 306, and wherein the at least one first lateral opening 305 is in a closed state when the at least one first lateral opening 305 is misaligned with the at least one second lateral opening 306.

The at least one second lateral opening 306 may be a portion of lateral shield element 306 which has been removed. The at least one second lateral opening 306 may correspond to the size and/or shape of the at least one first lateral opening 305. Alternatively, the at least one second lateral opening 306 may be larger than the at least one first lateral opening 305. When the at least one first lateral opening 305 and the at least one second lateral opening 306 are aligned with each other, the opening is therefore in an open state. The term "aligned" in the context of the present disclosure refers to a substantial overlap of the respective areas of the at least one first lateral opening 305 and the at least one second lateral opening 306. Similarly, when the at least one first lateral opening 305 and the at least one second lateral opening 306 are misaligned with each other, the opening is therefore in a closed state. The term "misaligned" in the context of the present disclosure refers to a substantial non-overlap of the respective areas of the at least one first lateral opening 305 and the at least one second lateral opening 306.

As exemplarily shown in FIGS. 3A and 3B, first shield element 301 includes two first lateral openings 305 arranged at approximately opposite sides of first shield element 301. Lateral shield element 302 includes one second lateral opening 306. FIG. 3A shows a first configuration wherein the second lateral opening 306 is misaligned with both first lateral openings 305. In this configuration, both of the two first lateral openings 305 are in a closed state.

Rotating lateral shield element 302 about longitudinal axis R allows for the configuration of shield 300 to be changed. For example, FIG. 3B shows a second configuration wherein lateral shield element 302 has been rotated approximately 90° in an anti-clockwise direction about longitudinal axis R. In this configuration, one of the two first lateral openings 305 is now aligned with the second lateral opening 306 so that one of the two first lateral openings 305 is in an open state. The other one of the two first lateral openings 305 remains misaligned with second lateral opening 306 such that the other one of the two first lateral openings 305 remains in a closed state. In the configuration shown in FIG. 3B, an electrical interconnect 103 may now be attached to terminal 206 so that it extends laterally through one of the two first lateral openings 305.

It follows that the lateral shield element 302, from the position shown in FIG. 3A, may alternatively be rotated approximately 90° in a clockwise direction about longitudinal axis R such that the other one of the two lateral openings 305 is changed to an open state.

Figure 4A:
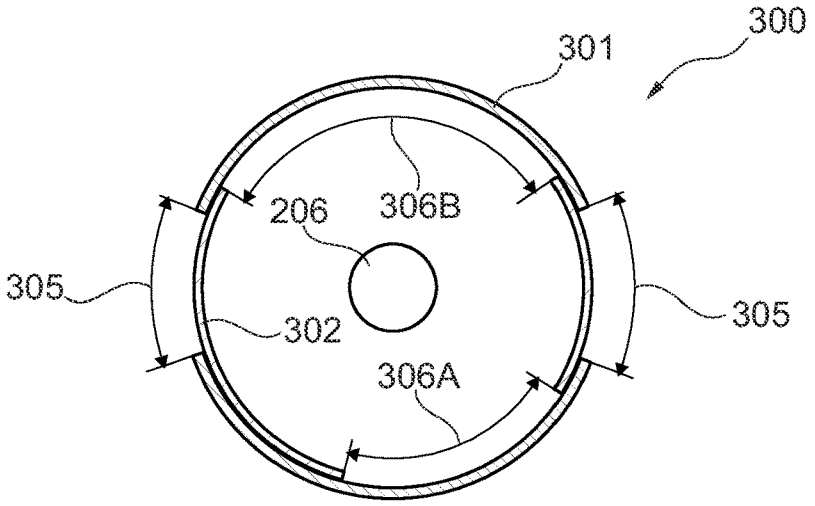
FIG. 4A-4C are schematic cross-sectional views of a shield for a terminal of a high-voltage device according to an embodiment of the disclosure.
Figure 4B:
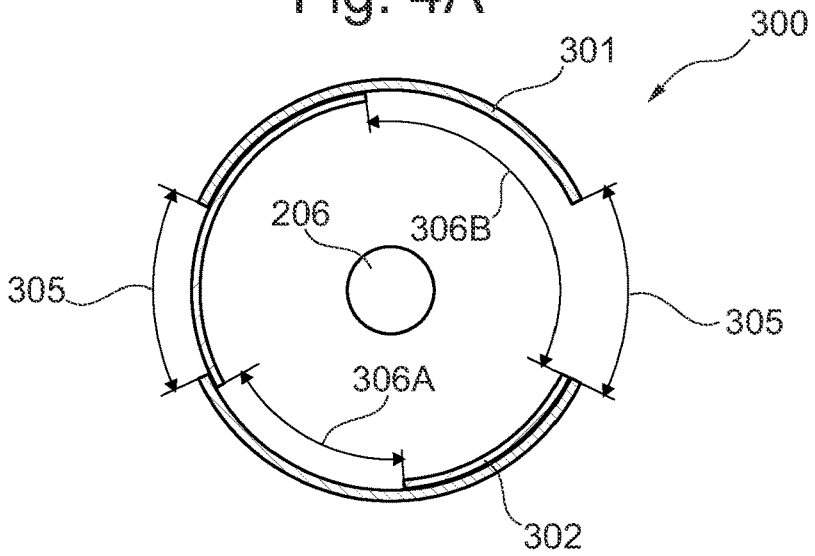
Figure 4C:
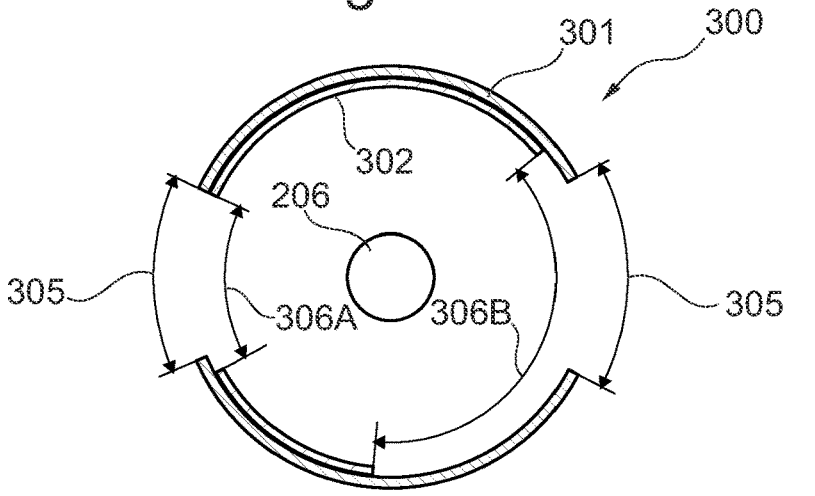

Reference will now be made to FIGS. 4A, 4B and 4C, which show cross-sectional top views of shield 300 according to embodiments described herein. Particularly, FIGS. 4A, 4B and 4C show cross-sectional views through section line B-B as shown in FIG. 2. Electrical interconnect 103 is not shown in FIGS. 4A, 4B and 4C for clarity.

Similarly to the example shown in FIGS. 3A and 3B, the example shown in FIGS. 4A, 4B and 4C show another example of an arrangement of openings such that shield 300 may be reconfigured. Referring firstly to FIG. 4A, first shield element 301 is again provided with two first lateral openings 305 arranged at approximately opposite sides of first shield element 301. However, in this case, lateral shield element 302 is provided with a small second lateral opening 306A and a large second lateral opening 306B. In the configuration shown in FIG. 4A, neither one of the small or large second lateral openings 306A, 306B are respectively aligned with either one of the two first lateral openings 305. Therefore, in this first configuration, both of the two first lateral openings 305 are in a closed state.

FIG. 4B shows a second configuration wherein lateral shield element 302 has been rotated in a clockwise direction about longitudinal axis R. In this second configuration, one of the two first lateral openings 305 is now aligned with the large second lateral opening 306B so that one of the two first lateral openings 305 is in an open state. The other one of the two first lateral openings 305 remains misaligned with small second lateral opening 306A such that the other one of the two first lateral openings 305 remains in a closed state. In the configuration shown in FIG. 4B, an electrical interconnect 103 may now be attached to terminal 206 so that it extends laterally through one of the two first lateral openings 305.

FIG. 4C shows a third configuration wherein lateral shield element 302 has been rotated further in a clockwise direction about longitudinal axis R. In this third configuration, one of the two first lateral openings 305 is still aligned with the large second lateral opening 306B so that one of the two first lateral openings 305 is in an open state, just like in FIG. 4B. However, the other one of the two first lateral openings 305 is now aligned with small second lateral opening 306A such that the other one of the two first lateral openings 305 is also in an open state. In the configuration shown in FIG. 4C, a first electrical interconnect 103 may now be attached to terminal 206 so that it extends laterally through one of the two first lateral openings 305, and a second electrical interconnect 103 may also be attached to terminal 206 such that it extends laterally through the other one of the two first lateral openings 305.

In the present disclosure, the arrangement of first and second openings 305, 306 is not limited to the arrangements shown in FIGS. 3A, 3B, 4A, 4B and 4C. Rather, any arrangement of first and second openings 305, 306 is possible.

According to an embodiment, which may be combined with other embodiments described herein, the at least one second shield element is an axial shield element 303 configured for opening or closing the at least one axial opening 304. As exemplarily shown in FIG. 2, axial shield element 303 may have a cap shape such that axial shield element 303 substantially covers the at least one axial opening 304.

In order to be configured to open or close the at least one axial opening 304, axial shield element 303 may be a removable cap, i.e. axial shield element 303 may be in a mounted position or in an unmounted position. FIG. 2 exemplarily shows axial shield element 303 in a mounted position. When in a mounted position, axial shield element 303 is configured for closing the at least one axial opening 304, i.e. the axial opening 304 is in a closed state such that terminal 206 is electrically shielded. Removing axial shield element 303, i.e. configuring axial shield 303 into an unmounted position, configures the axial opening 304 in an open state. When axial shield element 303 is in an unmounted position and axial opening 304 is in an open state, an electrical interconnect 103 may be mounted to terminal 206 such that electrical interconnect 103 extends in an axial direction through axial opening 304, i.e. in the direction of longitudinal axis R.

Axial shield element 303 may include a fastening means. The fastening means may be quickly and efficiently operated such that axial shield element 303 may be quickly and efficiently mounted and unmounted as required. For example, axial shield element 303 may include at least one screw or bolt which may be removed so that axial shield element 303 may be unmounted. Preferably, axial shield element 303 may include a bayonet mount as the fastening means.

Axial shield element 303 may be mounted to at least one of first shield element 301, lateral shield element 302, a part of body element 204 at a high voltage potential, conductor 205 and terminal 206. For example, axial shield element 303 may be mounted directly to conductor 205 such that axial shield element 303 is at the same electrical potential as conductor 205, while leaving terminal 206 free for mounting an electrical interconnect 103. Alternatively, axial shield element 303 may be mounted to first shield element 301 or lateral shield element 302 such that axial shield element 303 is at the same electrical potential as first shield element 301 and/or lateral shield element 302.

Figure 5:
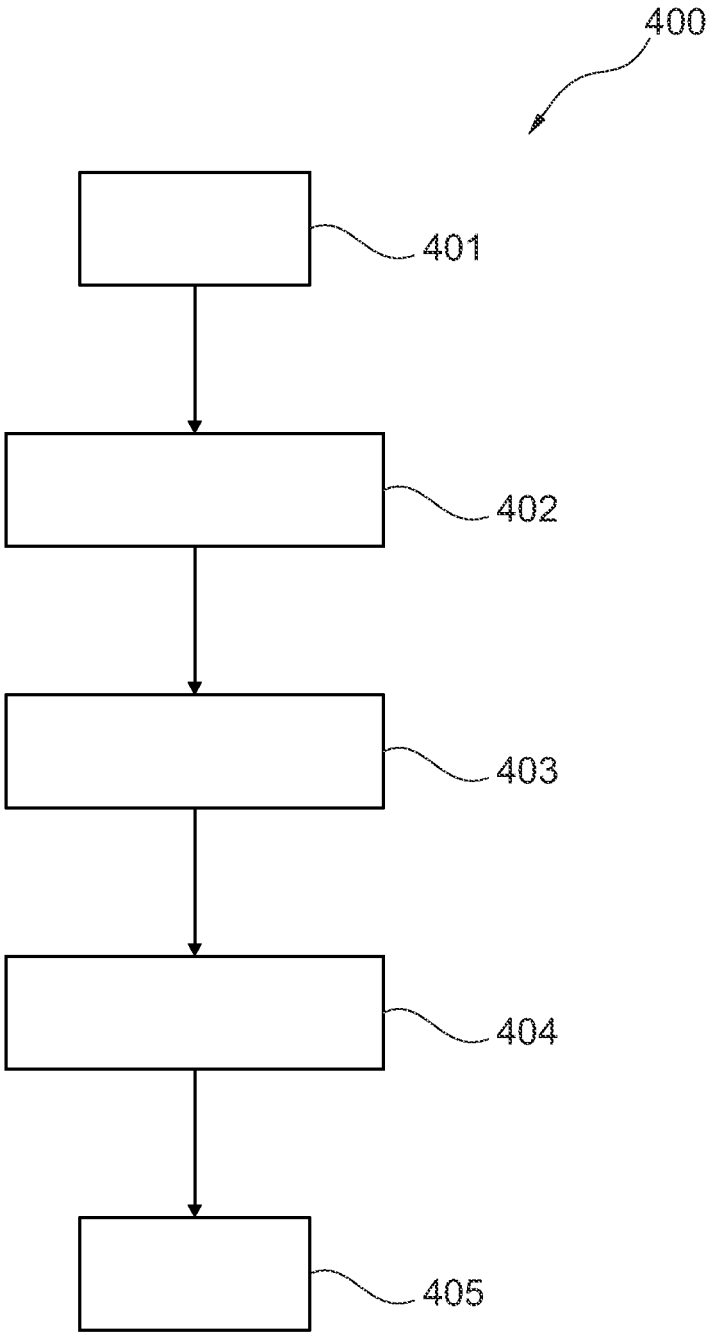
FIG. 5 is a flowchart of a method installing a high-voltage bushing according to an embodiment of the disclosure.

According to yet a further aspect of the present disclosure, a method 400 of installing a high-voltage bushing is provided. The high-voltage bushing includes a shield according to the aspects and embodiments described herein. Reference is now made to FIG. 5, which shows a flowchart of method 400. Method 400 commences at block 401. Method 400 includes mounting the high-voltage bushing in block 402, configuring the at least one axial opening and/or the at least one first lateral opening in an open or closed state in block 403, and terminating the high-voltage bushing in block 404. The method 400 concludes at block 405.

In block 402, method 400 includes mounting the high-voltage bushing. Mounting the high-voltage bushing 200 may involve fastening a mounting flange 203 to a mounting surface 105, for example, the housing of a transformer 100. The mounting flange 203 may be fastened such that the electrical bushing passes through mounting surface 105. Mounting flange 203 may include a number of flange mounting holes. Fasteners may be provided for securely fastening mounting flange 203 to mounting surface 105 such that the fasteners pass through the flange mounting holes and the mounting surface 105.

In block 403, method 400 includes configuring the at least one axial opening and/or the at least one first lateral opening in an open or closed state. The configuring may involve moving at least one of the first shield element 301 and the at least one second shield element 302, 303 from a first shield position to at least a second shield position. For example, the first shield position may be a configuration in which one of a first lateral opening or an axial opening is in a closed state, and a second shield position may be a configuration in which the respective first lateral opening or axial opening is in an open state. The configuring may further involve removing fasteners 307 prior to moving at least one of the first shield element 301 and the at least one second shield element 302, 303, and re-attaching fasteners 307 after moving at least one of the first shield element 301 and the at least one second shield element 302, 303.

According to an embodiment, which may be combined with other embodiments described herein, configuring the at least one first lateral opening in block 403 includes relative rotation between the first shield element and the lateral shield element. The relative rotation may include either one of rotating first shield element 301 and maintaining lateral shield element 302 in a stationary position, or rotating lateral shield element 302 and maintaining first shield element 301 in a stationary position. First shield element 301 may include at least one first lateral opening 305, and lateral shield element 302 may include at least one second lateral opening 306. Relative rotation between first shield element 301 and lateral shield element 302 allows for the positions of the at least one first lateral opening 305 and the at least one second lateral opening 306 to be configured. When shields 301, 302 are rotated relative to one another such that at least one first lateral opening 305 and at least one second lateral opening 306 are aligned, the at least one first lateral opening 305 is in an open state. Similarly, when shields 301, 302 are rotated relative to one another such that the at least one first lateral opening 305 and the at least one second lateral opening 306 are misaligned, the at least one first lateral opening is in a closed state.

According to an embodiment, which may be combined with other embodiments described herein, the configuring at least one axial opening in block 403 includes mounting or removing the axial shield element. Mounting axial shield element 303 configures the at least one axial opening in a closed state. Removing axial shield element 303 configures the at least one axial opening in an open state. Mounting or removing axial shield element 303 may include mounting or removing a fastening means, wherein the fastening means is configured for fastening axial shield element 303. For example, the fastening means may be a bayonet mount configured for detachably mounting axial shield element 303 to first shield element 301.

In block 404, the method 400 includes terminating the high-voltage bushing. In the context of the present disclosure, the term "terminating" refers to mounting at least one electrical interconnect 103 to at least one terminal 206 such that electrical interconnect 103 and terminal 206 are electrically connected. For example, terminal 206 may include a threaded portion and electrical interconnect 103 may include an eyelet portion. The high-voltage bushing may be "terminated" by mounting the eyelet portion of electrical interconnect 103 to terminal 206 and fastening the eyelet portion to terminal 206 with a nut engaging with the threaded portion. Electrical interconnect 103 may be mounted such that electrical interconnect 103 extends in an axial direction, i.e. substantially in the direction of longitudinal axis R. Alternatively, electrical interconnect 103 may be mounted such that electrical interconnect 103 extends in a lateral direction, i.e. substantially in a direction perpendicular to longitudinal axis R.

Terminating the high-voltage bushing may include electrically connecting at least one terminal 206 of high-voltage bushing 200 to another electrical device. For example, the high-voltage bushing 200 may be electrically connected to a transformer, an electrical breaker, or a bus bar.

According to an embodiment, which may be combined with other embodiments described herein, the terminating the high-voltage bushing in block 404 includes mounting at least one electrical interconnect to the terminal such that the at least one electrical interconnect passes through an open one of the at least one axial opening and/or the at least one first lateral opening. For example, in the case where at least one electrical interconnect 103 extends in a lateral direction, i.e. substantially in the direction perpendicular to longitudinal axis R, electrical interconnect 103 passes through the respective first lateral opening which has been configured in an open state. Similarly, in the case where at least one electrical interconnect 103 extends in an axial direction, i.e. substantially in the direction of longitudinal axis R, electrical interconnect 103 passes through the respective axial opening which has been configured in an open state.

While the foregoing is directed to aspects and embodiments of the disclosure, other and further embodiments of the disclosure may be devised without departing from the basic scope thereof, and the scope thereof is determined by the claims that follow.

The invention claimed is:

1. A shield for a terminal of a high-voltage electrical device comprising:

a first shield element having at least one axial opening and at least one first lateral opening; and at least one second shield element;

wherein the at least one second shield element may be positioned so that the at least one axial opening and/or the at least one first lateral opening is in an open state or a closed state.

2. The shield according to claim 1, wherein the high-voltage electrical device is a high-voltage bushing, particularly a high-voltage bushing for a transformer.

3. The shield according to claim 1, wherein the at least one second shield element is a lateral shield element configured for opening or closing the at least one first lateral opening, and the first shield element and the lateral shield element are arranged concentrically to one another.

4. The shield according to claim 3, wherein the at least one first lateral opening is changed between the open state and the closed state by relative rotation between the first shield element and the lateral shield element.

5. The shield according to claim 3, wherein the lateral shield element comprises at least one second lateral opening, wherein the at least one first lateral opening is in the open state when the at least one first lateral opening is aligned with the at least one second lateral opening, and wherein the at least one first lateral opening is in the closed state when the at least one first lateral opening is misaligned with the at least one second lateral opening.

6. The shield according to claim 3, wherein the first shield element comprises at least two first lateral openings, and the lateral shield element may be positioned such that a first one of the at least two first lateral openings is in an open state and a second one of the at least two first lateral openings is in a closed state.

7. The shield according to claim 1, wherein the at least one second shield element is an axial shield element configured for opening or closing the at least one axial opening.

8. The shield according to claim 1, wherein the shield has the same electrical potential as the terminal.

9. A high-voltage electrical bushing comprising a shield according to claim 1.

10. The high-voltage electrical bushing according to claim 9, wherein at least one electrical interconnect can be mounted to the terminal so that the at least one electrical interconnect extends in a lateral direction or an axial direction.

11. A transformer comprising at least one high-voltage electrical bushing according to claim 9.

12. A method of installing a high-voltage bushing having a shield according to claim 1, the method comprising:

mounting the high-voltage bushing;

configuring the at least one axial opening and/or the at least one first lateral opening in an open state or a closed state; and terminating the high-voltage bushing.

13. The method according to claim 12, wherein the high-voltage bushing has a shield, wherein the lateral shield element comprises at least one second lateral opening, wherein the at least one first lateral opening is in the open state when the at least one first lateral opening is aligned with the at least one second lateral opening, and wherein the at least one first lateral opening is in the closed state when the at least one first lateral opening is misaligned with the at least one second lateral opening, and wherein configuring the at least one first lateral opening comprises relative rotation between the first shield element and the lateral shield element.

14. The method according to claim 12, wherein the high-voltage bushing has a shield wherein the at least one second shield element is an axial shield element configured for opening or closing the at least one axial opening, and wherein configuring at least one axial opening comprises mounting or removing the axial shield element.

15. The method according to claim 12, wherein terminating the high-voltage bushing comprises mounting at least one electrical interconnect to the terminal such that the at least one electrical interconnect passes through the at least one axial opening and/or the at least one first lateral opening.

* * * * *